US006173671B1

(12) United States Patent
Casull

(10) Patent No.: US 6,173,671 B1
(45) Date of Patent: Jan. 16, 2001

(54) PORTABLE INFLATABLE FLOATATION DEVICE

(76) Inventor: Steven J. Casull, 1093 Eastridge Rd., Sandy, UT (US) 84090

( * ) Notice: Under 35 U.S.C. 154(b), the term of this patent shall be extended for 0 days.

(21) Appl. No.: 09/500,980

(22) Filed: Feb. 15, 2000

(51) Int. Cl.[7] ..... B63B 7/00

(52) U.S. Cl. ..... 114/345; 114/354; 114/61.25; 441/130

(58) Field of Search ..... 114/345, 354, 114/61.1, 61.24, 61.25; 441/35, 40, 126, 129, 130

(56) References Cited

U.S. PATENT DOCUMENTS

| | | | | |
|---|---|---|---|---|
| 5,217,400 | * | 6/1993 | Creek et al. | 441/132 |
| 5,290,196 | * | 3/1994 | Steel | 441/130 |
| 5,692,450 | * | 12/1997 | Alter et al. | 114/354 |
| 5,711,240 | * | 1/1998 | Baker | 114/345 |
| 5,878,688 | * | 3/1999 | Merrett et al. | 114/354 |
| 6,083,062 | * | 7/2000 | Treloar et al. | 114/354 |

* cited by examiner

*Primary Examiner*—Stephen Avila

(74) *Attorney, Agent, or Firm*—M. Reid Russell

(57) ABSTRACT

A portable inflatable floatation device for use as a backpack frame to maintain a standard backpack thereto for hiking, with the back pack frame being convertible into floatation device seat, foot rest, and outrigger pontoon mounting. Inflatable pontoons that are to be carried on or in the backpack and are inflated into long cylindrical pontoons at a water site, whereat, with the back pack frame converted to the water craft seat, the seat is attached to span across the pair of parallel inflated pontoons and the outrigger portions of which seat are positioned to rest on and are strapped onto tops of the inflated pontoons, with top and bottom sections of the frame, respectively, pivoted to form and seat back and to a planar attitude with a seat bottom as a foot rest, and straight narrow spacers are secured, as with straps, to the forward and rear pontoon ends completing the floatation device. Removable oar locks may be secured to the outrigger portions for receiving oars assembled from components that are for transported on or in the back pack or a paddle may be assembled from which components for use inpaddling the device. The seat back can be lowered and pinned in place to extend in a planar attitude from the seat bottom to receive a cot cover installed between the spacers, arranging the floatation device as a sleeping platform, and the invention may further include a spring bar type tent for fitting to cover the sleeping platform.

15 Claims, 6 Drawing Sheets

PORTABLE INFLATABLE FLOATATION DEVICE

BACKGROUND OF THE INVENTION

1. Field of the Invention

This invention relates to inflatable floatation devices used for recreational purposes that are for carrying on and as an inclusion with a hikers pack to form a pontoon type floatation device suitable for lake or stream travel.

2. Prior Art

Pontoon type float devices for transporting a person on a body of water are not new, with such devices ranging from inner tubes, for supporting a swimmer or fisherman, to large heavy rubber pontoons for supporting a passenger compartment for running rapids. An example of such a fisherman's float device is shown in a Creek, et al., U.S. Pat. No. 5,217,400 that shows a seat arranged between a pair inflated tubes that a fisherman sits on. Which arrangement is not a pontoon device like that of the invention.

Pontoon float devices are, however, shown in Steel, U.S. Pat. No. 5,290,196; to Baker, U.S. Pat. No. 5,711,240; and to Merritt, et al., U.S. Pat. No. 5,878,688, with the Merritt, et al., device employing rigid pontoons. The Steel and Baker patents, like the invention, show seat structures supported between a pair of inflatable pontoons. However the pontoons of these patents are not light in weight nor are they readily filled and deflated. The pontoons of the Steel and Baker patents are unlike those of the invention that are easily transported, in a collapsed condition, by a single hiker who carries them in sacks, or the like, that are attached to a back pack, and with the back pack frame configurable to serve as a seat of the floatation device of the invention. Nor are the devices of these patents capable of being reconfigured into a sleeping platform that may include a tent, or the like, as is the invention, whose seat can be configured as a platform to support a person lying thereon, and with the pontoons having tabs fixed thereto for receiving tent posts fitted into holes in which tabs and pushed into the ground to receive a section of a tent material stretched there over.

BRIEF SUMMARY OF THE INVENTION

It is therefore a principal object of the present invention to provide a twin pontoon type water craft that includes a pair of individual pontoons that are each light in weight and collapsible so as to be fitted into and carried in a pocket of, or separate container for, suspension to a hikers back pack, which individual pontoons can be easily inflated and are for mounting to a seat structure that a back pack frame converts into and is attached across the pontoons for supporting an individual seated thereon and operating the water craft on a stream or lake surface.

Another object of the present invention is to provide a backpack frame that is arranged to be maintained by straps to a hikers back and can be reconfigured as the water craft seat and including strapping for mounting the seat between the pair of inflated pontoons.

Another object of the present invention is to provide, as an additional backpack frame capability, for its being reconfigured into a bed frame for suspension between the pontoons and to receive a mattress structure such as a pad, cot cover, inflatable mattress, or the like, to accommodate a person lying thereon.

Still another object of the present invention is to provide a sleeve for individually containing inflatable pontoon bladders that include tabs secured at their ends and having a reinforced hole formed therethrough to accommodate a tent pole like structure fitted therethrough and passed into a surface, with a number of which poles arranged to maintain a tent type covering structure stretched there over.

Still another object of the present invention is to additionally provide, as an accessory to the invention, a spring bar tent arrangement for mounting to tent poles maintained to the water craft pontoons, where each of at least a pair of tent poles is bent into an arch with individual pole ends fitted through spaced tabs secured onto each of the pontoon outer sleeves with the tent pole ends each pushed into the ground whereon the pontoons are positioned.

Still another object of the present invention is to provide a twin pontoon type water craft that is easily and conveniently transported by a single hiker in or mounted onto their back pack and with the back pack frame, and accessories capable of being reconfigured into components of the water craft, and accessories therefore.

The invention is in a readily and easily transportable water craft for supporting a person that is conveniently assembled from items transported in and on a backpack and backpack frame that is for transporting a person on a stream or lake surface. The water craft and its accessories are collapsible and deflatable so as to be capable of being transported in or hanging from a back pack of a single hiker. A bladder and outer sleeve for each pontoon is arranged to be collapsed so as to fit into a sack or sacks for attachment onto the backpack, with the backpack frame constructed to be folded and extended from its pack supporting attitude into a water craft seat and including strapping for mounting to the inflated pontoons. In which pack frame reconfiguration, a lower backpack waist support converts into a thigh rest with a backpack upper back rest to serve as a flexible cloth seat to receive the users buttocks therein, and with the backpack frame top or head end arranged to pivot and extend into a seat back, with pivot frame sides each to be rotated to extend oppositely and outwardly to rest upon and be strapped onto a midsection of an outer top surface of each pontoon, and the bottom or lower frame end to be extendable to support a persons legs resting thereon.

A collapsible paddle or pair of collapsible oars can be included with the invention, where, to accommodate oars, the frame sides are to each receive an oar lock fitted thereto to extend upwardly and with each oar lock to accommodate an oar fitted therein. The seat back is adjustable to be positioned in the plane of or planar to the seat bottom and its extension that supports the persons thighs and feet, providing a flat platform that can receive a cot cover fitted there over as a sleeping platform that accommodates a mattress, such as an inflatable mattress, whereon a person can lay down. Further, as an optional inclusion, individual tabs can be secured to extend outwardly from the surfaces of each of the pontoon sleeves that are to receive tent poles fitted therethrough that are passed into a surface, such as the surface of a beach whereon the water craft is positioned. With such tent poles to support a covering stretched therebetween forming a tent. The pole and covering combination can be at least a pair of telescoping poles each fitted through a sleeve or through loops formed in or extending from a section of a tent type material, with, when at least a pair of poles are each bent into an arc, and with the pole ends fitted through the holes in the tabs extending from the pontoon sleeves, a spring bar type tent is provided for covering the water craft.

DESCRIPTION OF THE DRAWINGS

In the drawings that illustrate that which is presently regarded as the best mode for carrying out the invention.

DETAILED DESCRIPTION

Figure 1:
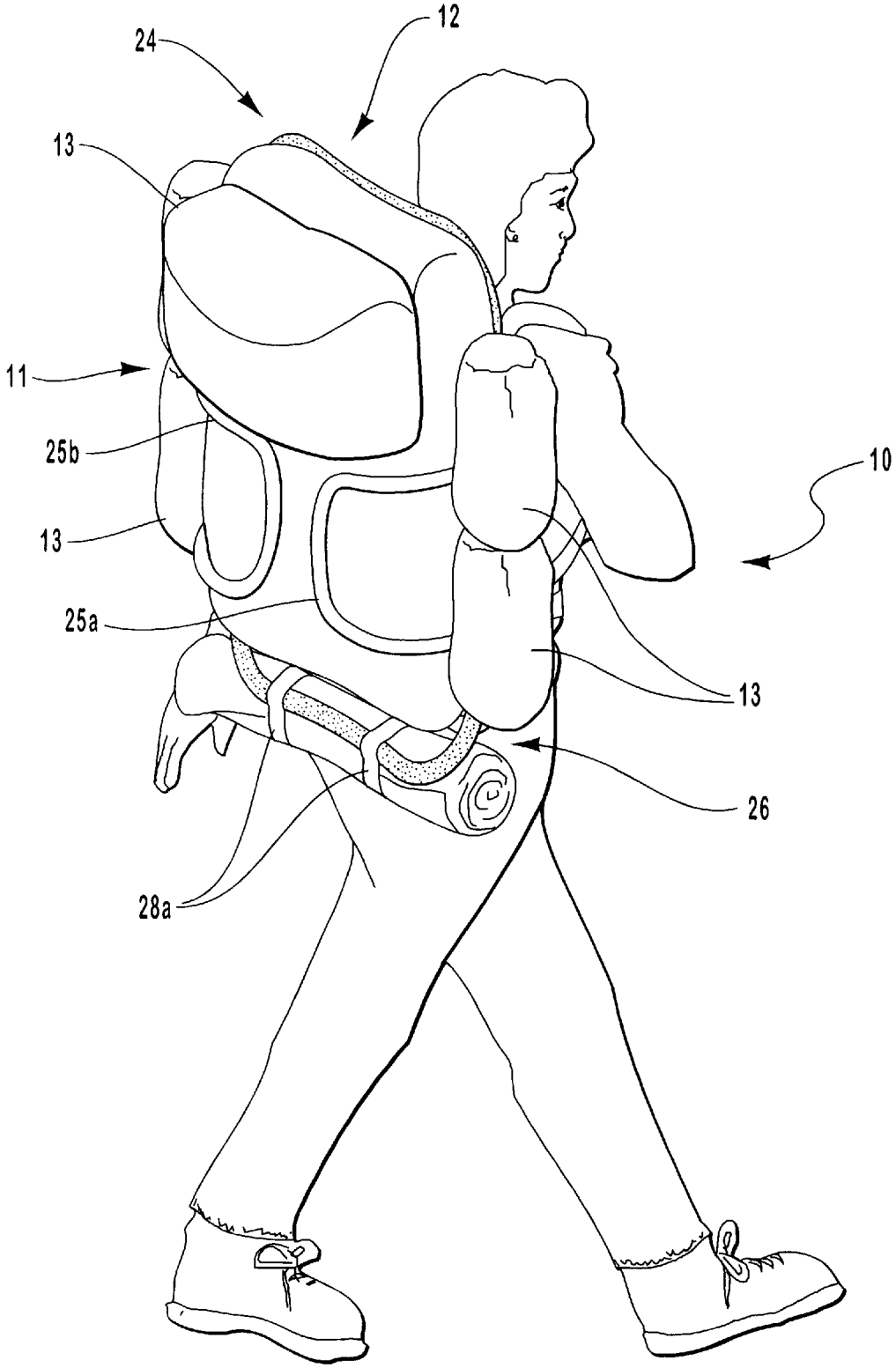
FIG. 1 is a rear perspective view of a hiker wearing a backpack that is part of and contains the invention in a portable inflatable floatation device.

FIG. 1 shows a hiker 10 carrying a fabric backpack 11 maintained onto pack frame 12 fitted across the hikers shoulders, and showing sacks 13 maintained to pack frame 12 pack support sides 25*a* and 25*b*, as by straps. The backpack 11 may be a conventional item containing pockets, sacks and the like, or my be specially configured to contain and maintain components of the invention, within the scope of this disclosure.

Figure 2A:
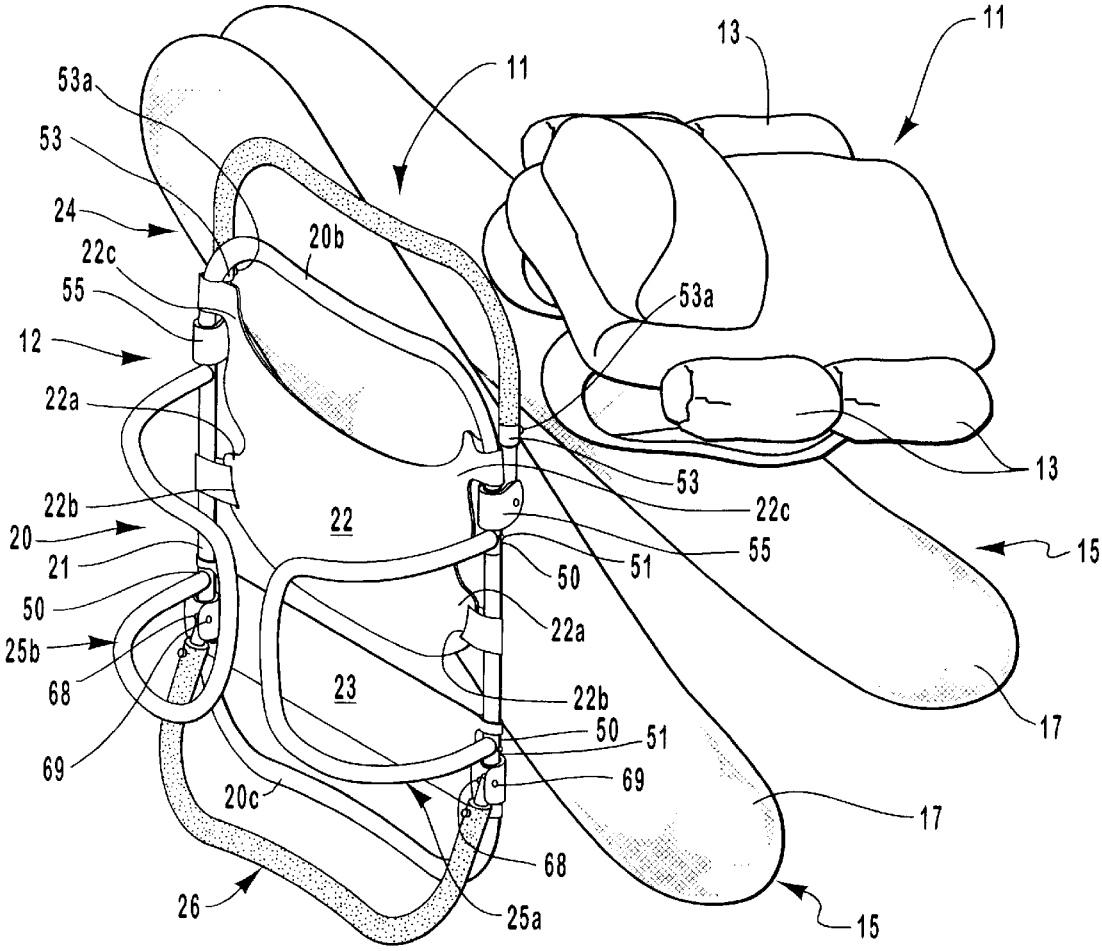
FIG. 2A shows the backpack of FIG. 1 removed off from the hikers back and shows pontoon bladders that have been fitted into outer sleeves and inflated, and showing the pack as having been removed off from the backpack frame that is shown as including a rectangular support with pack top, side and bottom pack support bars, the top and bottom support bars arranged to pivot outwardly from the plane of a flat back section of the frame and showing the side support bar ends as collars that are fitted over sides of the frame flat back section.
Figure 2B:
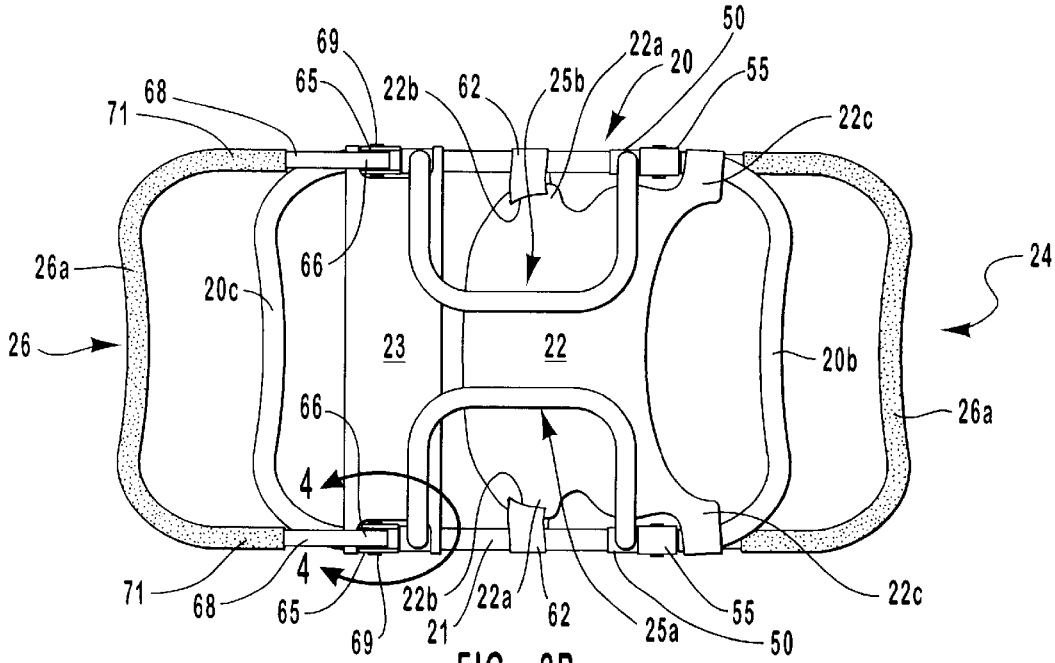
FIG. 2B shows a bottom plan view of the backpack frame of FIG. 2A prior to the pack support side bars being rotated outwardly as wings for mounting onto the pontoons, as shown in FIG. 3.
Figure 3:
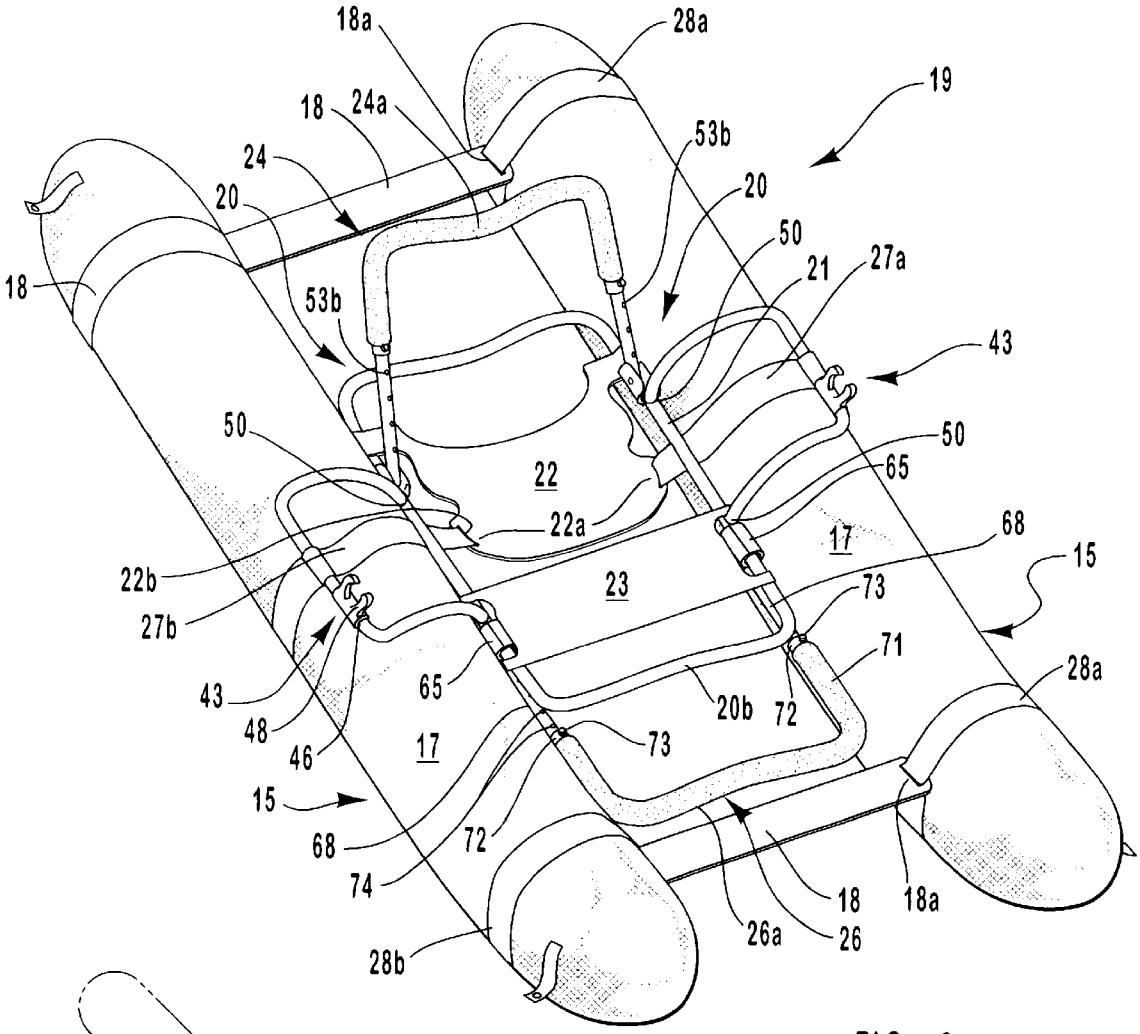
FIG. 3 shows the assembled portable inflatable floatation device as including the pontoon bladders fitted into the sleeves of FIG. 2A and inflated, shows the pack frame sides as having been pivoted rearwardly to the frame back to form wings that extend oppositely and are individually for positioning onto to extend partially across each inflated pontoon and sleeve and showing straps extending from the pack frame upper back support and across wings outer sides and around each of the pontoons for maintaining the pontoons positioned alongside the frame sides and showing the pack frame top bar telescoped outwardly and pivoted into a seat back between the inflated pontoons, with a pack frame upper backpack support arranged to receive a persons buttock, and with a frame lower back plate for supporting a persons upper legs, and showing a pack frame lower backpack support pivoted to the plane of the pack frame and telescoped outwardly as a foot rest.
Figure 4:
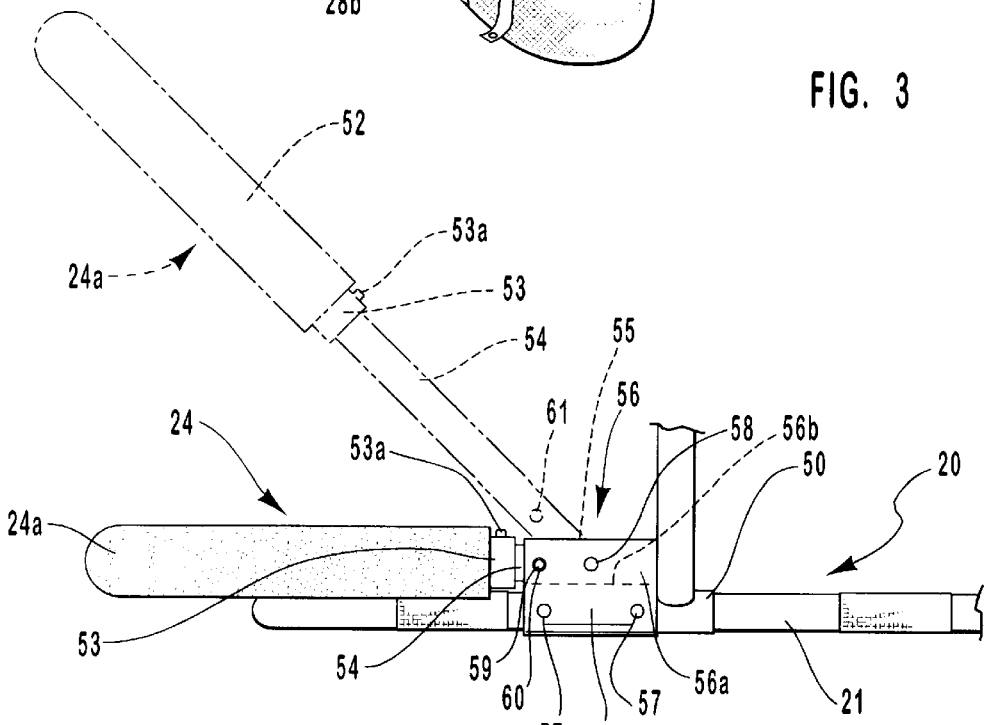
FIG. 4 shows an enlarged side elevation perspective sectional view taken within the line 4—4 of FIG. 2B showing a side of the pack frame upper pack support rail moved from its planar attitude to the pack frame configuration of FIG. 2A, to, as shown in broken lines, its seat back attitude of FIG. 3, and showing a pin fitted behind the erected seat back for holding it in position.
Figure 5:
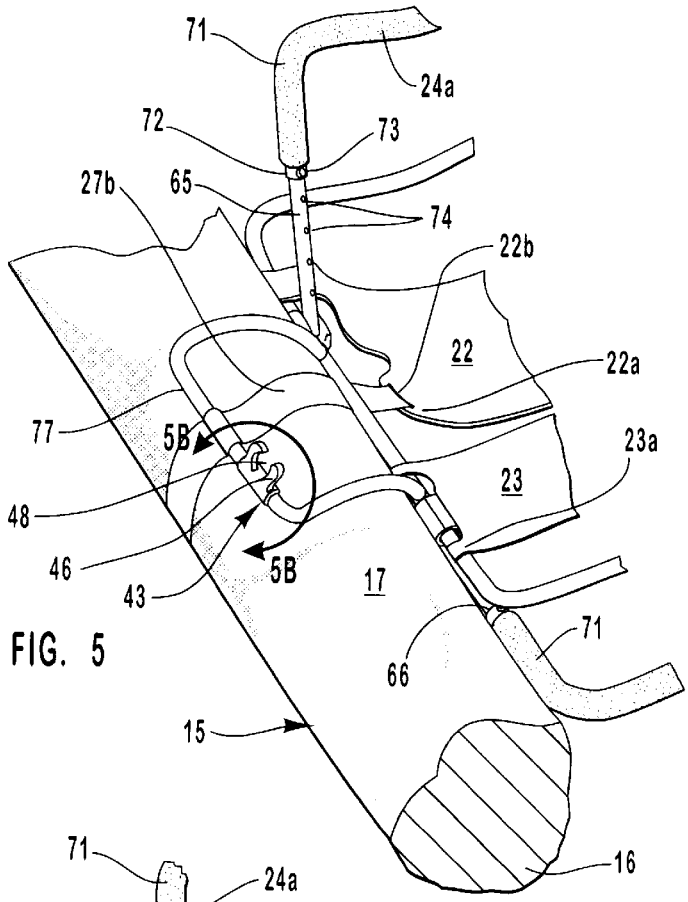
FIG. 5 shows a side elevation section of the frame top bar pivoted and telescoped into its seat back position, with the bottom pack support bars pivoted upwardly to the plane of the frame flat back section and telescoped into a loot rest and showing an oar lock mounted onto each of the side pack support bars.
Figure 5B:
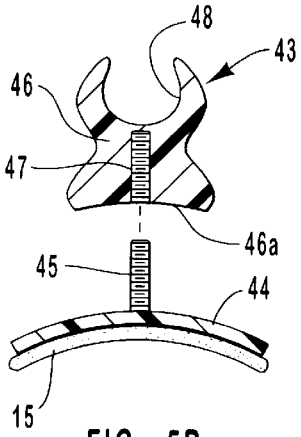
FIG. 5B shows an enlarged exploded sectional view taken within the line 5B—5B of FIG. 5 showing the oar lock components exploded apart.
Figure 5A:
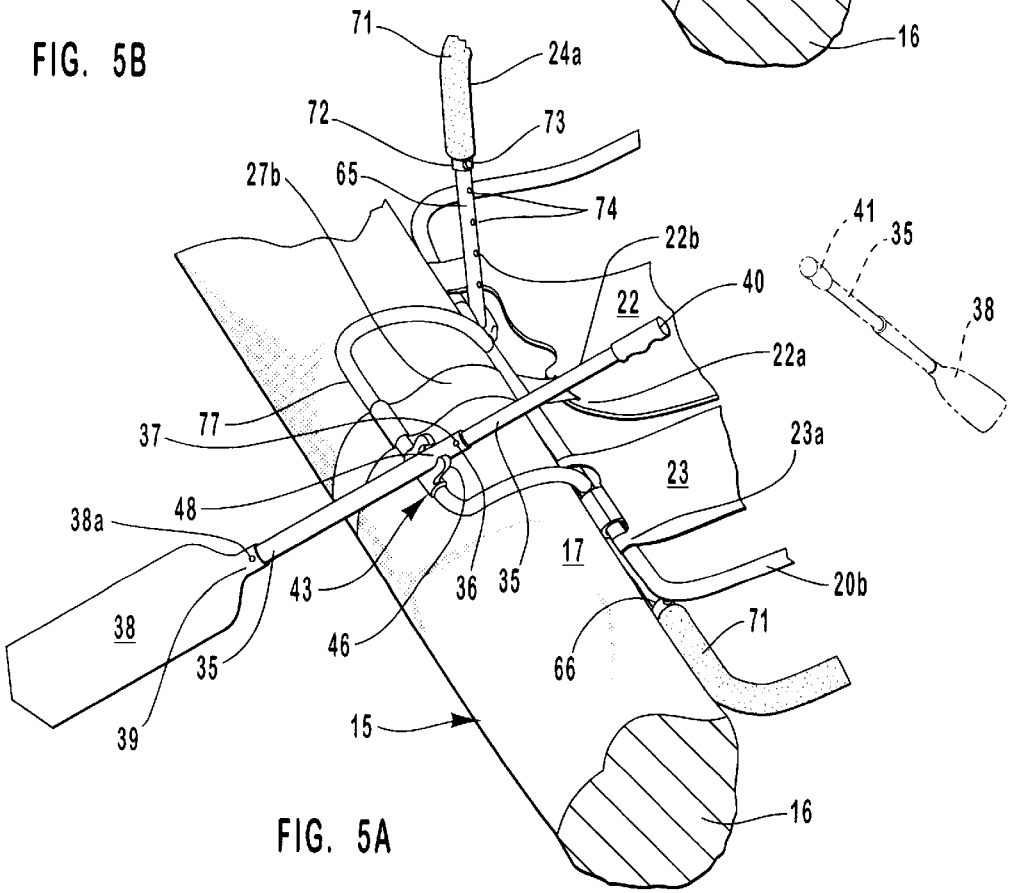
FIG. 5A shows an oar fitted into the open lock portion of the oar lock of FIG. 5, and shows a paddle handle end aligned for substitution for the oar hand grip end.

In FIG. 2A the backpack 11 is shown as having been removed from the pack frame 12, showing filled pontoons 15 that each includes a bladder 16, shown in a broken away section in FIG. 5A, that are each contained in a sleeve 17, which bladder and sleeves have been removed from the pack 11 and with each bladder having been fitted into a sleeve 17 and filled with air as through a bladder fill nozzle, not shown, forming air filled pontoons 15, as shown also in FIG. 3. The pack fame 12, shown in FIGS. 2A, 2B, and reconfigured as a seat in FIG. 3, includes a flat back section 20, that is preferably formed from metal pipes, tubes, or the like, as a continuous outer rectangular support 21 that is open across its center and whereacross an upper back support 22 and a lower torso support 23 are strung. The upper back support 22 is to receive a person's buttock and the torso support 23 is to support that person's upper thighs when the invention is configured as a water craft, as described later herein with respect to FIGS. 3 through 5A.

Figure 6:
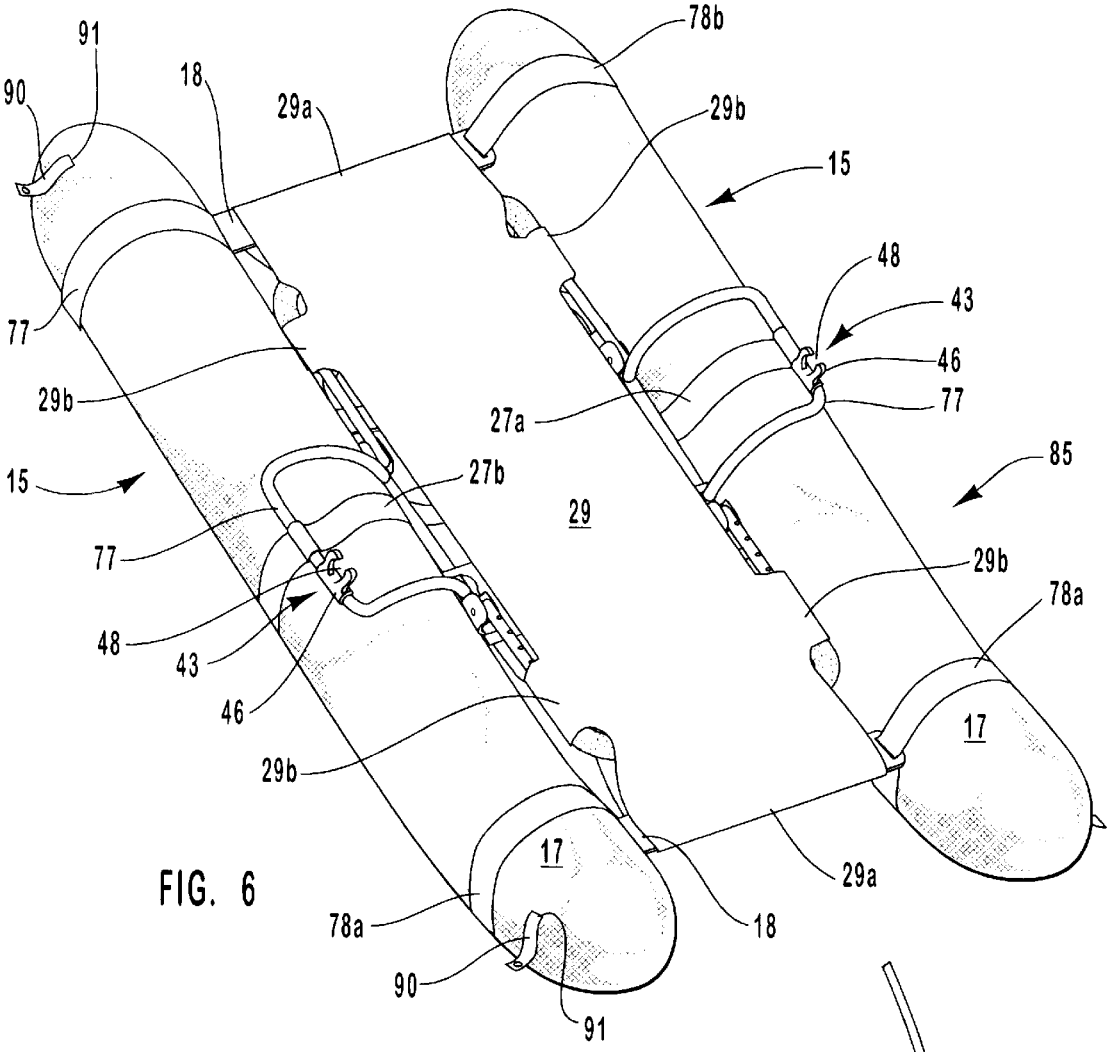
FIG. 6 shows the portable inflatable floatation device of FIG. 3 reconfigured as a sleeping platform with the seat back of FIG. 4 shown extending from and planar to the frame top and with the bottom pack support shown also in a planar attitude and telescoped outwardly, forming a flat surface that is shown covered by a section of a fabric material, or cot cover, that is maintained to the pack frame components by straps that encircle spacers fitted across the forward and rear pontoon ends.
Figure 7:
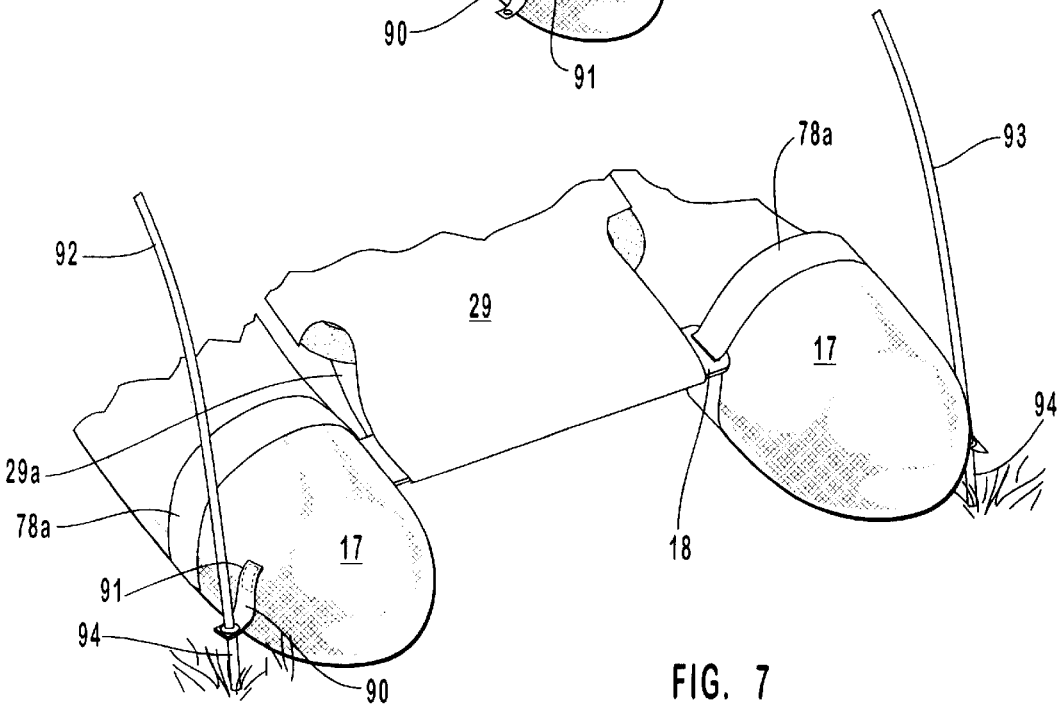
FIG. 7 shows forward end view of a section of the sleeping platform of FIG. 6 showing the pontoon sleeves as including tabs connected to outer surfaces of the sleeve ends that each have reinforced holes formed therethrough that receive and pass a tent pole that is then pushed into a ground surface.
Figure 8:
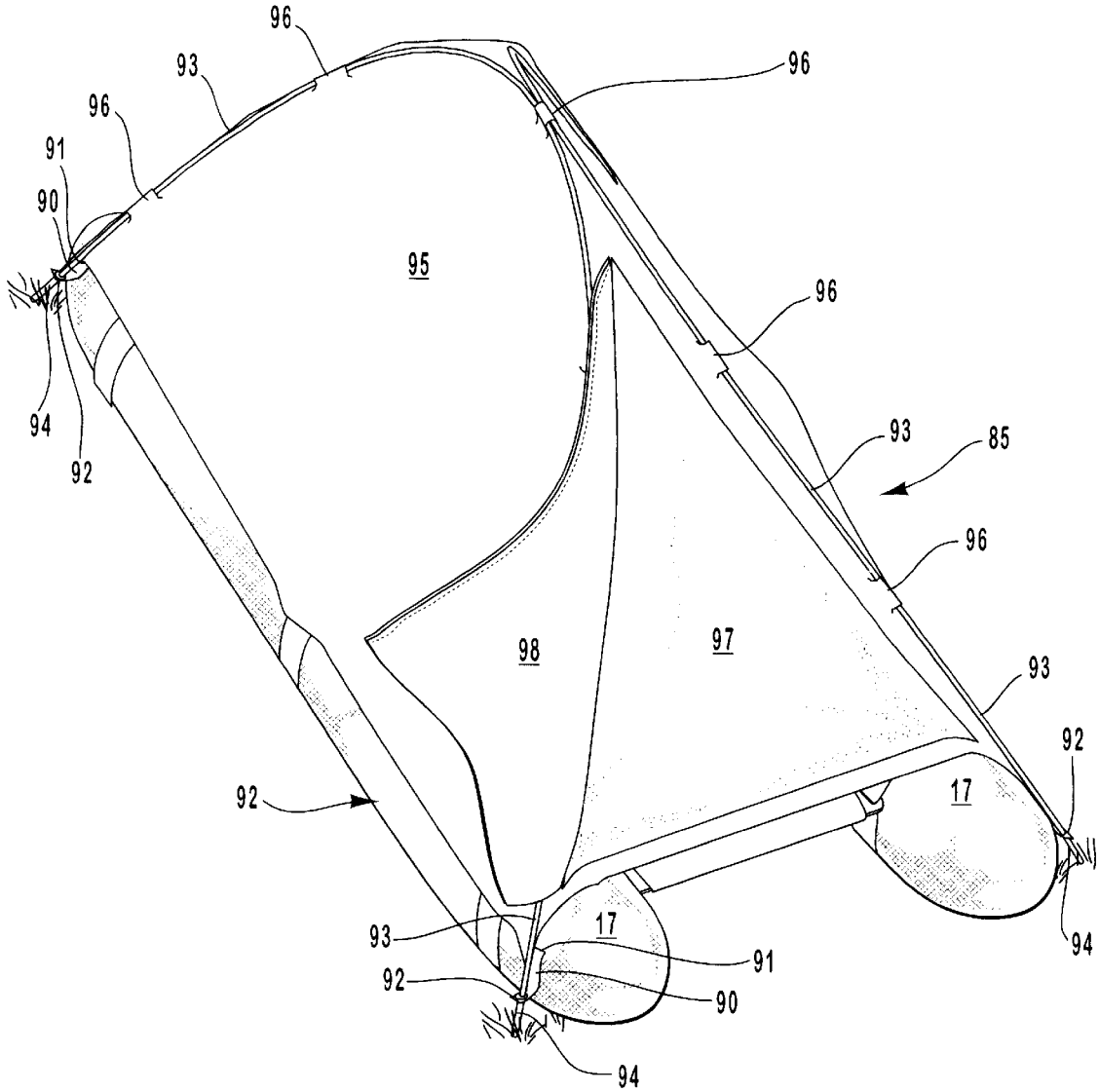
FIG. 8 shows the floatation device of FIGS. 6 and 7 with a tent maintained to the tent poles of FIG. 6 and showing a tent flap pulled back showing the tent bottom supported on the sleeping platform of FIG. 6.

Additional to the pack frame 12, as shown in FIGS. 2A and 2B, top, side and bottom pack support bars 24, 25*a* and 25*b*, and 26, respectively, are fitted to the flat back section 20 of rectangular support 21 to extend therefrom, with the side pack support bars 25*a* and 25*b* each extending at approximately a right angle rearwardly and with the top pack support bar 24 shown planar to the rectangular support 21. The top pack support bar 24 is to support a persons back as a seat back when the invention is configured as a floatation device 19, as shown in FIG. 3. The top pack support bar 24 can be telescoped outwardly, extending a U-shaped section 24*a* therefrom, as shown in FIG. 3. The side pack support bars 25*a* and 25*b* are curved inwardly to approximate the curve of an inflated pontoon 15 and are to fit partially therearound when configured as floatation device 19. The backpack 11 is maintained as with straps or strapping, shown as separate pairs of straps 27*a* and 27*b* to the pack frame 12, that are shown removed in FIG. 3 for connecting the pontons 15 to the pack frame 12 flat back section 20 configured as the water craft seat, and a pair of straps 28*a*, or the like, can be included with the pack 11, as desired for connecting the invention elements, as set out hereinbelow, with straps 28*a* shown in FIG. 1 maintaining a rolled up mattress to the lower pack support bar 26. Which straps, or other straps as carried in pack 11 can be used to individually attach respectively, the side support bars 25*a* and 25*b* to the seat and to spacers 18, as shown in FIGS. 3, 5 and 5A. Which spacers 18 are thin flat rectangular members to fit in pack 11 and each includes slots 18*a* formed therethrough across their opposite ends to receive straps. Shown as straps 28*a* and 28*b* fitted therethrough that are passed around each pontoons 15 end. The spacers 18 to span across the gap between which pontoons and serve as a head end and foot rest, respectively, for the water craft. Further, as discussed below, a cloth section 29, that is preferably a section of thick canvas, or the like, can be fitted to the seat 12, extending across the spacers 18, as shown in FIGS. 6 through 8, so as to cover the pack frame 12 that show the top pack support bar 24 in its planar configuration and stretched between the spacers 18, as will be discussed later herein.

Accordingly, the floatation device 19 configured, as shown in FIGS. 3, 5A and 5B, is to accommodate a person, sitting on a seat having a back rest maintained between pontoons 15 and provides for supporting the persons legs on the lower torso support 23 and supports their legs on the telescoped bottom pack support bar 26 outwardly telescoped U-shaped end section 26*a*. When the pack frame 12 is configured as a sleeping platform, as shown in FIGS. 6 through 8 the seat back is lowered to a planar attitude, and a cot cover 29 is installed there over, stretched between the spacers 18. In which attitude, the cot cover 29 ends 29*a* are wrapped around the spacers 18, with the cot cover side tabs 29*b* fitted around the outer sides, respectively, of the telescoped top and bottom pack support bars 24 and 26, and are folded back upon themselves and coupled using snap couplings, Velcro type fasteners, or the like.

Preferably, the backpack 11 is configured to accommodate individual tube sections 35 that, as shown in FIG. 5A, are assembled as by telescoping the one section 35end into another section end to where a ball type detent 36 that is maintained in a lesser diameter end of a section 35, will pass into a hole 37 formed in a greater diameter tube section 35 end. The tube sections 35 are thereby releasably coupled into a pole that is to receive a paddle or oar head 38 fitted thereto, with a ball portion of detent 36 of a lower tube section passing into a hole 38*a* that is formed in a paddle neck 39. The oar assembly is completed by installing a hand grip 40 onto the assembled tube sections 35 top end. Alternatively, a paddle handle 41 can be fitted to the assembled tube sections 35 top end to provide a paddle for use where the operator does not wish to row the water craft. For such oar or paddle handle, 40 or 41, installation, the tube section 35 has a narrow diameter end that includes a ball detent, the ball thereof extending outwardly, with the paddle hand grip or oar handle including a larger diameter neck end to fit over the tube section 35 narrow end, and with the ball of the detent, to extend into a hole is which paddle handle or oar handle larger diameter neck. So arranged, by selection of a number of tube sections 35 for telescope coupling together, each to include a paddle head 38 fitted as a lower end thereto, and by coupling either an oar handle 40 or a paddle handle 41 to the opposite or top end, either a pair of oars or a paddle can be so formed for propelling the floatation device 19. Where oars are to be so used, an oar lock 43 is provided for releasable coupling onto a side support bar 25*a* or 25*b*, as shown in FIGS. 3, 5 and 5A to allow a person to row the water craft. The oar lock 43, as shown best in FIG. 5B, includes an arcuate base 44 whose undersurface is curved to the curve of the pontoon 15 and is for fitting under and extending across the side support bar 25*a* or 25*b*, and has a rod 45 secured to the inner surface thereof for fitting through a hole formed through each web of the pack side support bars 25*a* or 25*b*. The oar lock 43 includes stem 46 that has a center longitudinal threaded hole 47 formed therein for turning onto the threaded bolt 45 end drawing the base 44 and oar lock under surface 46*a* tightly onto the side support bar with a U-shaped open area 48 of which oar lock 43 to receive an oar fitted therein, as shown in FIG. 5A. Also, while not shown in FIG. 2, the backpack 11 can contain other accessories such as straps, clamps, and the like, for use in assembling the floatation device 19, and reconfiguring it into a bed, with or without a tent, as shown in FIGS. 6 through 8, within the scope of this disclosure.

Additionally, as shown in FIG. 2B , the pack frame 12 has been separated from the backpack 11 with the side and bottom pack support bars 25*a*, 25*b* and 26 facing upwardly from the flat back section 20. The side pack support bars 25*a* and 25*b* are pivoted, as shown in FIG. 3, around the flat back section sides 20*a* to extend therefrom as outriggers such that curved portions thereof will each fit partially around an inflated pontoons 15. To provide pack frame 12 reconfiguration, the ends of each of the U-shaped pack support bars 25*a* and 25*b* are each secured, at approximately right angles, to an outer surface of a short sleeve 50 that is fitted over to pivot around a long side of the flat back section 20 rectangular support 21. Each sleeve includes holes 51 formed therethrough that align with a hole or holes formed through each of the sides 20*a*, holes 51 to receive a pin, or the like, fitted therethrough to maintain the sides 25*a* and 25*b* in either a first position like that shown in FIGS. 1, 2A and 2B, where the sides 25*a* and 25*b* maintained over pack 11, or a second position like that shown in FIGS. 3, 5, 5A and 6, where the sides 25*a* and 25*b* are rotated to an outrigger attitude to mount the pontoons 15 thereto. Alternatively, another coupling arrangement, such as an arrangement of ball type detents, for locking the side pack support bars 25*a* and 25*b* in either the backpack maintaining attitude or pontoon mounting configurations could be so used within the scope of this disclosure.

Shown in FIGS. 2A, 2B, 3, 4, 5 and 5A, and best in FIG. 4, the pack frame 12 top support bar 24 can be pivoted from its backpack 11 holding attitude, shown in FIG. 1, to a seat back configuration shown in broken lines in FIG. 4, and in FIGS. 3, 5 and 5A, and the U-shaped outer section 26*a* thereof can be telescoped out to a fully extended attitude. In which extended attitude, as shown in FIGS. 6 through 8, the bottom support bar 26 and the outer section 26*a* thereof are in the plane of and extend planar from the flat back section 20, with the outer section 26*a* to function as a foot portion of a sleeping platform 85 of FIG. 6. To provide for the alternative top support bar 24 positioning to function as a seat back, as shown best in FIG. 4, the top support bar 24 ends each include a straight rod 54 that is telescoped into a collar 53 secured across an open end of each of the of tubular sides 52 of the U-shaped top section 24*a* of the top support bar 24. The rods 54 travel through the collars 53, telescoping into which tubular sides 52, and are maintained therein by turning of set screws 53*a* into each collar 53 and into engagement in one of a plurality of spaced holes or openings 53*b* that are formed along the straight rods 54, locking the straight sides and tubular sides 52 in place. Lower ends 55 of each of the straight rods 54 are fitted between parallel plates 56*a* of a double channel sections 56 that consists of parallel plates 56*a* separated by a center longitudinal wall 56*b*, shown in broken lines, with the parallel plates 56*a* fitted onto each rectangular support 21 side, the wall 56*b* resting on the top of which side, and a pivot coupling of each top support bar rod 54 end 55 is provided by installing a pin 58 across the sides 56*a*, passing through the bar rod 54 end 55, providing a pivot coupling. So arranged, the top support bar 24 can be pivoted from a planar attitude with the rectangular support 21 to a seat back when configured as shown in FIG. 3. The top support bar 24 is maintained or locked in its planar attitude by fitting a pin 59, or like fastener, through a rear hole 60 formed through plates 56*a* to pass through hole 61 formed in the top support bar rod end 55, and, with the top support bar 24 pivoted to a seat back attitude, the pin 59 is installed through hole 60 to act as a brace against top support bar end 55 surface, holding it in an erected attitude, as shown in broken lines in FIG. 4.

As set out above, the top support bar 24 is capable of being positioned between a planar attitude where the pack frame 12 is configured to support a backpack 11 and for use as a top end portion of sleeping platform 85, as shown in FIGS. 6 through 8. With the top support bar to be pivoted into a seat back attitude as shown in FIGS. 3, 4, 5 and 5A. For safety, the top support bar 24 top section is preferably coated with a soft flexible material such as a foam cylinder, to function as a back or neck rest, and is the open area thereacross and can be fitted with a web or net, not shown, maintained thereover as a back or upper body support. The web or net, not shown, can be formed as by weaving horizontal and vertical strips into a mat or net, with the ends thereof to be passed around sides and between the top of which top support bar 24*a* and around the flat back section 20 rectangular support 21 top end 20*b*, and the ends folded upon themselves and joined with snaps, or like fasteners.

Shown in FIGS. 2A, 2B, 3, 5 and 5A, the open area of the flat back section 20 rectangular support 21 is spanned by the upper back support 22 and lower torso support 23. The upper back support 22 is preferably a flat rectangular section of a flexible material such as canvas, or the like, having side extensions 22*a* that extend from bottom corners and have slots 22*b* formed thereacross to receive straps 62 fitted therethrough and are looped around the flat back section 20 rectangular support 21 sides and are folded upon themselves and jointed, as by rivets or like fasteners, with top corners 22*c* formed as straps that are also looped around the flat back section sides 20*a* and connected, as by rivets. Further, with the pack frame 12 configured as water craft seat, straps 27*a* and 27*b* are also fitted through slots 22*b* to pass around and hold the pontoons 15 in place, as shown best in FIG. 3. So arranged, a person will position their buttocks in the flexible upper back support 22 to paddle or row the floatation device 19. Further, the lower torso support 23, as shown in FIGS. 2A, 2B and 3 is preferably a rectangular section formed from a stiff material such as wood, hard plastic, or the like, and is secured at its opposite bottom and top ends 23*a* and 23*b*, respectively, onto the flat back section 20 rectangular support 21 sides to support the thighs of a person sitting in the upper back support 22.

As shown in FIGS. 2A, 2B, and 5A, the bottom pack support bar 26 is like the top pack support bar 24, as shown best in FIG. 4, except that support bar 26 is arranged on the opposite side of the flat back section 20 rectangular support 21 relative to the top pack support bar 24. Shown best in FIG. 1, with the pack frame 12 mounting the backpack 11, the bottom pack support bar 26 is pivoted rearwardly from the vertical to maintain a rolled foam mattress, and is planar to the flat back section 20 rectangular support 21 and beneath the bottom end 20*c* thereat in the attitude shown in FIGS. 3, 5 and 5A. Like the top pack support bar 24, the bottom pack support bar includes rod sides 68 that each have ends 66 and have like diameters to fit between spaced parallel plates 65 that have a pivot pin 69 fitted therethrough and through a hole, not shown, in each rod end 66, providing a pivot coupling. The parallel plates 65, in turn, are secured to the back section 20 rectangular support 21 sides and like the plates 56*a* of FIG. 4 that receive pin 59 fitted therethrough, a separate pin, not shown, may be fitted through which plates 65 and through a rod end 66 to brace against the side of the rod end 66 to maintain the bottom pack support bar 26 in a planar attitude to the back section 20 when the bottom pack support bar 26 is pivoted to the attitude shown in FIG. 1. Further, as needed, the bottom pack support bar rods 68 can be supported, as with C clamps, not shown, or the like, to the flat back section 20 rectangular support 21 sides. Also, like the top pack support bar 24, the bottom pack support bar preferably includes a U-Shaped top section 26*a* whose tubular sides 71 are to telescope over the upper ends of rod sides 68 to pass through collars 72 fixed to the open ends of sides 71, with each collar 72 to include a bolt 73 turned into a collar threaded hole, the bolts to be turned into engagement with a surface of side rod 68, fitting into one of a series of spaced depressions 74 formed therein, locking collar 72 to which rod side 65, maintaining the U-shaped section 26*a* in its extended attitude, as shown in FIGS. 3, 5, and 5A and best in FIG. 3.

In assembling the floatation device 19, the inflated pontoons 15 are positioned on the ground to be spaced apart and parallel with the outer sleeves 17 of each pontoon 15 to receive the outwardly pivoted side pack support bars 25*a* and 25*b*, respectively, positioned thereon. The curved portions of which pack support bars to fit closely to the pontoon shape, as shown in FIGS. 3, 5 and 5A, and are held in place by passing straps 27*a* and 27*b* around the pontoons and support bars 25*a* and 25*b* and across the flat back section 20 rectangular support 21 sides fitting through the upper back support sides 22*a* and slots 22*b* and are held in place by buckles, not shown. To further assemble the floatation device 19, the spacers 18 are positioned between the pontoon 15 front and rear ends and pairs of front and rear straps 28*b* and 28*a*, respectively are fitted around the pontoon ends, are passed through lateral slots 18*a* formed in the ends of spacers 18 and are fitted through buckles, not shown. The bottom pack support bar 26 sides 68 are then pulled out of the collar 72 ends of the support bar U-shaped end 26*a* to a desired distance whereat each collar bolt 73 is turned to urge a bolt end into one of the spaced holes 74 formed along the sides 68, locking the U-shaped end 26*a* in place, as shown in FIGS. 3, 5, and 5A.

As desired, a net or web, not shown, can then be installed between the bottom pack support bar 26 U-shaped end 26*a* and the flat back section 20 rectangular support 21 lower end 20*b*. So arranged, the floatation device 19 is ready to be moved into water with a person seating themselves on the pack frame 12 that has been reconfigured in a seat, as described. The persons buttocks and upper thighs are positioned on, respectively, the upper back support 22 and lower torso support 23, and their lower legs are supported on the flat back section rectangular support 21 end and their feet rest on the U-shaped end 26*a* of the bottom pack support bar 26.

As set out above, the floatation device 19 can be moved through water by oars or with a paddle. Further, the floatation device 19 is light in weight and is easily moved onto land and can there be simply and easily reconfigured into a bed or sleeping platform 85, as shown in FIG. 6. Such reconfiguration involves repositioning, as set out above, the pack frame 12 top pack support bar 24 to extend outwardly in the plane of the flat back section 20 rectangular support 21, forming a planar surface between the pontoons 15. So arranged, the cot cover 29 can be fitted on top of the seat and extends between the spacers 18. The cot cover connecting sides 29*a* are fitted around the rectangular flat back section 20 support 21 sides and each side 29*a* is folded back upon itself and is maintained thereat by joining snaps, or the like together. So arranged, with the cot cover ends 29*b* fitted around the spacers 18, and folded upon themselves for joining with snaps, or the like, a sleeping platform 85 is formed.

Further, as shown in FIGS. 7 and 8, the pontoon outer sleeve 17 includes tabs 90 that are secured,as by sewing, at their ends 91 to the sleeve outer surfaces, near the pontoon ends. The tabs 90 include reinforced holes or grommets 92 that each receives an end of a flexible tent pole 93 of a tent frame 95 fitted therethrough. Which tent poles are preferably bent into arches to receive a section of a flexible tent material 95*a* fitted and maintained there over, as shown in FIG. 8. The tent poles to be fitted through sleeves 96 that are sewn onto the tent material, suspending the tent material from the tent frame 95 covering the floatation device 19 as shown in FIG. 8. The tent pole 93 ends 94 are urged into the ground whereon the floatation device sits and with a tent floor 97 positioned on the sleeping platform cot cover and can receive a mattress, sleeping bag, or the like, position thereon. Which tent may and preferably does include a closable front flap 98, or the like, as shown in FIG. 8 that is open to reveal the tent interior.

Further, as required, anchor ropes, not shown, can be connected between front and rear tent ends for anchoring the tent ends to a rock, tree, or the like, and the tent poles 92 ends 93 can include points mounted thereto to facilitate the pole ends being urged into the ground.

While a preferred embodiment of my portable inflatable floatation device and features thereof have been shown and described herein, it should be understood that the present disclosure is made by way of example only and that variations and changes thereto are possible without departing from the subject matter shown herein as a best mode for carrying out the invention and a reasonable equivalency thereof as come within the scope of the following claims, which claims I regard as my invention.

I claim:

1. A portable inflatable floatation device comprising, a backpack frame having flat back section formed from suitable sections of tube material to have a rectangular outer shape with at least one cross tube and including a pair of like, outwardly projecting, backpack side support bars that are each formed from a single tube that is bent at spaced right angles to where the single tube ends are aligned, and each said single tube end is formed into a side pivot coupling means whereby each said single tube end couples to one of said flat back section sides, allowing said side support bar to pivot around each said flat back section side and including means for releasably maintaining each said side pivot coupling means to one of said flat back section sides, and a top pack support bar formed from a single tube that is bent at spaced angle bends to where said tube ends align and including top pivot couple means secured to each said top pack support bar end for mounting to a top section of said flat back section and including means for releasable maintaining said each top pivot coupling means to said flat back section top, whereby, said sides and top pack support bars, when positioned in a first attitude, receive a backpack maintained onto said flat back section, and with said sides and top pack support bars pivoted relative to said flat back section to a second position, said side pack support bars form pontoon supports and said top pack support bar forms a seat back; a pair of pontoons each having a bladder with means for passing air therein to fill each said each bladder into an clongate cylindrical pontoon; and means for maintaining each said pontoon onto each of said side pack support bars.

2. A portable inflatable floatation device as recited in claim 1, wherein the top pack support bar includes a U-shaped outer section that is open at its ends and includes a collar across each said end; a pair of like straight rods each having a first rod end for fitting through and telescoping into each said collars; means for locking said collar onto said straight rod; and pivot means for pivotally mounting a second end of each said straight rod end onto a side of the flat back section.

3. A portable inflatable floatation device as recited in claim 2, wherein the pivot means includes a pair of like plates that are secured, in spaced relationship, to the sides of each of the flat back sections to receive a second straight rod end and including a pin fitted through said pair of plates and through said second straight rod end, forming the pivot coupling; and further including a second pin for fitting through said pair or plates and either through a second hole in said second straight rod end, or to fit beneath said straight rod blocking travel of said straight rod to a planar attitude to the flat back section when the top pack support bar is in a seat back attitude.

4. A portable inflatable floatation device as recited in claim 1, further including a bottom pack support bar for pivotal attachment to extend from bottom of the flat back section having a U shaped outer section formed from a tube section that is bent into a U shape having parallel sides that are open at their ends with each said end including a collar fitted thereacross to receive a straight rod, and which said straight rods are have their lower ends fitted onto the sides of the flat back section, and including, with said collar, attachment means for releasably connecting said U shaped outer section ends to said telescoped rod ends to allow said U shaped outer section to be displaced away from said flat back section bottom, and further including a pivot coupling of the straight rods lower ends onto the sides of said flat back section that includes a pair of parallel plates coupled to opposite sides of said flat back section sides and including a pin fitted through said parallel plates that passes through a hole formed through each straight rod lower end, and including a second pin for fitting through said parallel plates that, when said bottom pack support bar is positioned in a planar attitude to said flat back section, fits through a second hole through each of said straight rods and, when said bottom pack support bar is pivoted away from said flat back section, is positioned behind said straight rods blocking pivoting back to the planar attitude.

5. A portable inflatable floatation device as recited in claim 1, further including at least a pair of spacers formed as flat narrow rectangular sections of a stiff material to fit between the spaced pontoons and connect across said pontoons front and rear ends, which said spacers include slots formed across their opposite ends to receive straps fitted therethrough that are passed and releasably secured around said pontoons ends.

6. A portable inflatable floatation device as recited in claim 4, wherein the top and bottom pack support bar U shaped sections are fitted with rolls of a soft flexible foam material; and the straight rods each include a plurality of spaced depressions that bolts extending from the collars, as the attachment means, are turned into, locking the U shaped sections to the straight rods.

7. A portable inflatable floatation device as recited in claim 1, further including a section of a webbing or net material secured between the top of the flat back section and the web of the U spaced section of the top pack support bar.

8. A portable inflatable floatation device as recited in claim 1, further including an upper back support formed from a flat section of a flexible material that is secured at its opposite sides to the upper portions of the sides of the flat back section, extending thereacross; and a torso support formed as a rectangular section having ends thereof arranged for coupling to lower portions of the sides of the flat back section, extending thereacross.

9. A portable inflatable floatation device as recited in claim 5, further including a section of flexible material formed to have approximately the length of the pontoons and having a width to span the distance between the pontoons when they are arranged as a floatation device and including ends for wrapping around the spacers when the top pack support bar is in a planar attitude to the flat back section that can be folded back upon themselves and releasably secured, said section of flexible material having sides to fit around said flat back section sides and fold upon themselves forming a cot cover when the invention is arranged as a sleeping platform.

10. A portable inflatable floatation device as recited in claim 1, further including a pair of oar lock means individually arranged for mounting to extend upwardly from a web section of each of the side pack support bars to receive a body of an oar fitted therein.

11. A portable inflatable floatation device as recited in claim 10, wherein each oar lock means includes a base having an undersurface that conforms to the pontoon outer surface and includes a straight rod extending upwardly from a top surface of said base that is threaded and is for passage through a hole formed through a web of a U-shaped side support bar; an oar support having a U-shaped body that includes a web between upright arms, which said oar support body web includes a flat lower surface wherefrom a straight stem extends that includes an axial hole formed therein that is threaded to receive the straight rod end fitted and turned therein to clamp the side support bar web between said base and said oar support web undersurface.

12. A portable inflatable floatation device as recited in claim 10 further including a pair of oars, with each said oar formed from a plurality of straight tubular sections formed for telescoping together into a straight shaft of an appropriate oar length; a paddle head that includes means for axially coupling a neck end said paddle head to one end of said straight shaft; and an oar handle that includes a hand gripping portion and means for axially coupling said oar handle onto an opposite end of said straight shaft to said paddle head.

13. A portable inflatable floatation device as recited in claim 1, further including at least a single paddle that is formed from a plurality of straight tubular sections that are arrange for telescoping together into a straight shaft of an appropriate paddle length; a paddle head that includes means for axially coupling a neck end of said paddle head to one end of said straight shaft; and a paddle handle that includes a hand gripping portion and means for axially coupling said paddle handle onto an opposite end of said straight shaft to said paddle head.

14. A portable inflatable floatation device as recited in claim 1, wherein the pair of pontoons each include an inflatable bladder formed as a closed cylinder from an air retaining material and including a means for filling said bladder with air; and an outer sleeve formed from a durable flexible material to receive said bladder fitted therein prior to said bladder inflation, and including mid and forward sections tabs each secured across its end to extend from said sleeve surface and having a hole formed therethrough for receiving ends of poles fitted therethrough, with said poles for forming a tent frame for receiving a section of a tent material fitted and maintained thereto.

15. A portable inflatable floatation device as recited in claim 14, wherein the tent poles and tent material form a spring bar type tent having a tent bottom to fit between the pontoons and including a tent flap to close over an opening into said spring bar type tent.

* * * * *